US007472455B2

(12) United States Patent
Dolton

(10) Patent No.: US 7,472,455 B2
(45) Date of Patent: Jan. 6, 2009

(54) PORTABLE HAIRSTYLISTS' STATION AND METHOD

(76) Inventor: Tamara C. Dolton, 7700 Hayfield Rd., Alexandria, VA (US) 22315

( * ) Notice: Subject to any disclaimer, the term of this patent is extended or adjusted under 35 U.S.C. 154(b) by 582 days.

(21) Appl. No.: 11/161,283

(22) Filed: Jul. 28, 2005

(65) Prior Publication Data

US 2007/0022561 A1 Feb. 1, 2007

(51) Int. Cl.
*A47L 5/00* (2006.01)

(52) U.S. Cl. ..... 15/323; 15/414

(58) Field of Classification Search ..... 15/323, 15/301, 310, 314, 315, 414
See application file for complete search history.

(56) References Cited

U.S. PATENT DOCUMENTS 5,205,013 A * 4/1993 Lopes ..... 15/301
5,359,461 A * 10/1994 Rice et al. ..... 359/874
5,505,524 A 4/1996 Drumwright
5,533,799 A 7/1996 Nickolaus, Jr.
5,547,393 A 8/1996 Jansen
5,946,768 A 9/1999 Kelly
5,967,632 A 10/1999 Lamia
6,659,339 B2 12/2003 Konishi
2006/0123712 A1 * 6/2006 Nolting ..... 52/36.1

OTHER PUBLICATIONS

"Care Cuts" web page printed Jun. 7, 2005, url: http://www.carecuts.com/.
"Onsite Haircuts" web page printed Jun. 7, 2005, url: http//www.onsitehaircuts.com/index.php.
"Hair on Wheels" web pages printed Jun. 7, 2005, url: http://haironwheels.net/.

* cited by examiner

*Primary Examiner*—Dung Van Nguyen
(74) *Attorney, Agent, or Firm*—WRB - IP LLP

(57) ABSTRACT

A portable hair stylists' station includes a case and a vacuum cleaner, the vacuum cleaner including a canister associated with the case and a hose connected to a suction opening of the canister. A method for conducting a hairstyling business is also disclosed.

22 Claims, 3 Drawing Sheets

PORTABLE HAIRSTYLISTS' STATION AND METHOD

BACKGROUND AND SUMMARY

The present invention relates to hairstylists' stations and, more particularly, to a portable hairstylists' station.

The typical business model for modern hairstylists involves a salon in a building. This type of "brick and mortar" type of salon involves substantial expense that must be paid for from the fees charged by the hairstylists who work at the salon. In addition, because many customers are employed during normal business hours, e.g, 9 AM to 5 PM, Monday through Friday, and they cannot get to the salon during those times, a substantial amount of the salon business is conducted after 5 PM on Monday through Friday or during weekends. This makes it difficult for hairstylists to see family members who are at work or at school during the peak business hours for the salon. As a result, many hairstylists have to make a choice between their families and their jobs.

It is known for some hairstylists to travel to their customers' homes or workplaces. Usually, this involves the hairstylist having to improvise some kind of makeshift hairstyling station depending upon what is available wherever the work is to be performed. There are various disadvantages to this, such as the hairstylist become fatigued or the job being performed poorly when the customer is seated in a chair that is at a height that is inconvenient for the hairstylist, the hairstylist not being able to use certain equipment, and the hair and other waste from the job being scattered around.

It is desirable to provide greater flexibility in terms of working hours and locations for hairstylists. It is also desirable to provide an organized arrangement to facilitate hairstylists to perform hairstyling operations in virtually any location at any time.

In accordance with an aspect of the present invention, a portable hair stylists' station comprises a case and a vacuum cleaner comprising a canister associated with the case and a hose connected to a suction opening of the canister.

In accordance with another aspect of the present invention, a method for conducting a hairstyling business comprises scheduling a hairstyling appointment for a customer at a customer location to be performed by a hairstylist at another location at the time of scheduling, transporting the hairstylist and a portable hairstylists' station to the customer location, and performing a hairstyling operation at the customer location using the portable hairstylists' station.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
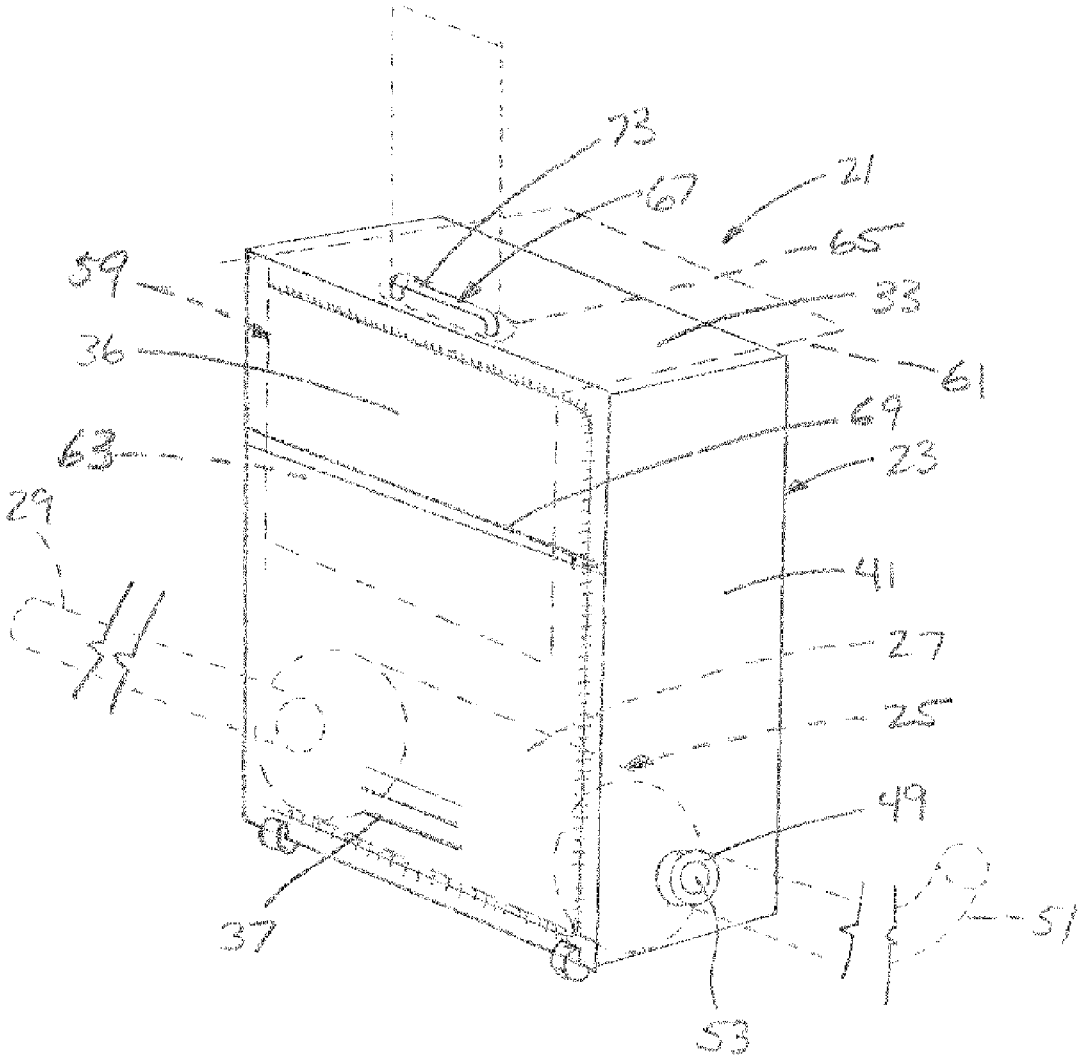
FIG. 1 is a schematic perspective view of a portable hairstylists' station according to an embodiment of the present invention.
Figure 2:
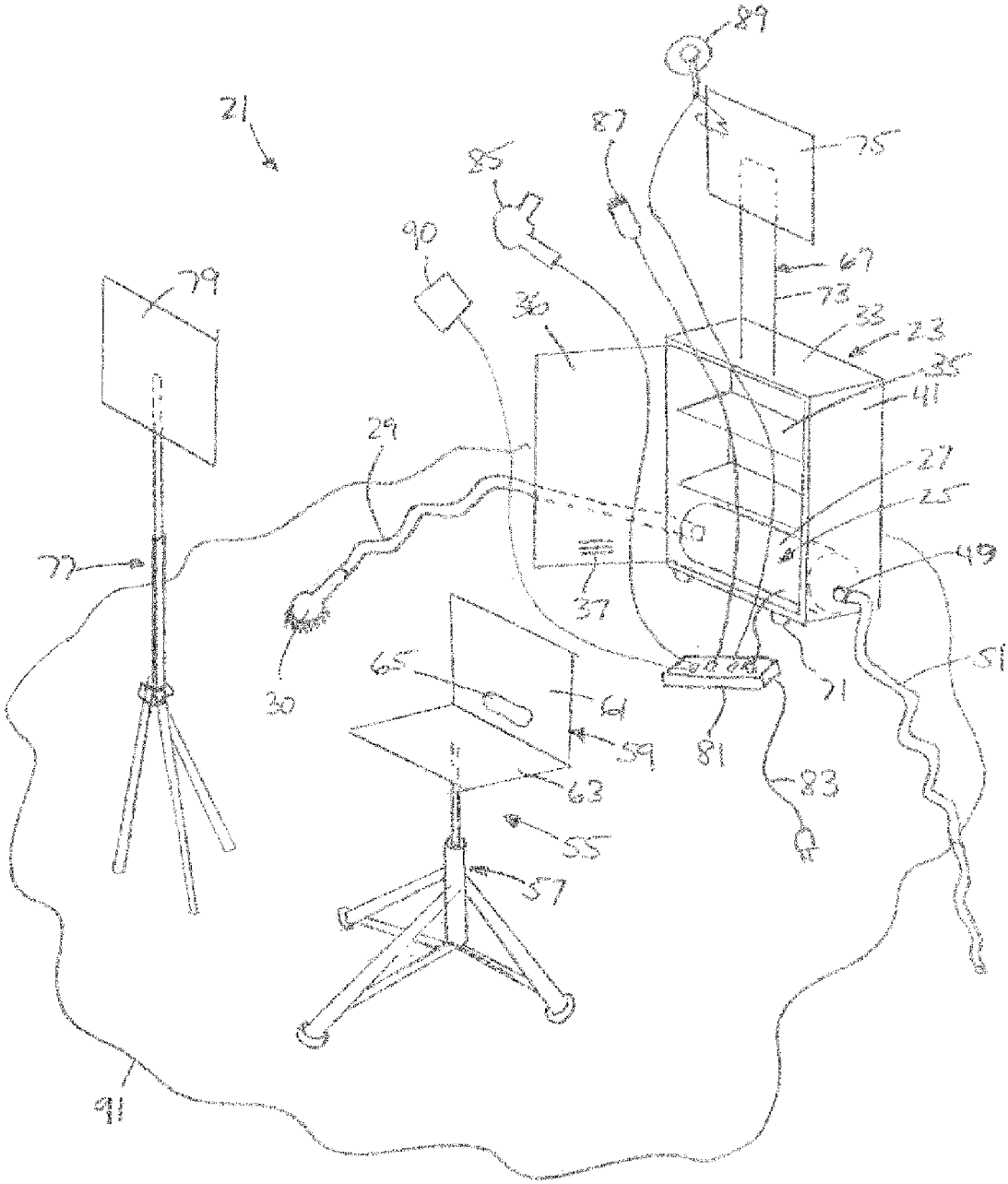
FIG. 2 is a schematic perspective view of the portable hairstylists' station of FIG. 1 in an open condition.

A portable hair stylists' station 21 according to an embodiment of the present invention is shown in FIGS. 1 and 2. The station 21 comprises a case 23 and a vacuum cleaner 25 comprising a canister 27 associated with the case and a hose 29 connected to a suction opening 31 (FIG. 3) of the canister. Ordinarily, the canister 27 is disposed inside of the case, however, the canister may be disposed outside of the case. A brush 30 suitable for use in removing hair from a customer can be attached to the hose 29, as can other conventional vacuum attachments.

The case 23 may be similar in size and shape to a conventional suitcase, e.g., current U.S. airline regulations for checked baggage typically limit size to approximately L+W+H=62" (approx. 157 cm), and the total weight of the station 21 will ordinarily be no more than approximately 50 lbs (approx. 23 kg) or, in any event, sufficiently light to permit a person in generally good health to carry the case up several flights of stairs. Of course, larger and smaller cases 23 can also be used, and the total weight of the station will depend upon factors including the preferences of the user, who may wish to carry more or fewer supplies than ordinary, and may be greater than or less than 50 lbs (approx. 23 kg).

The case 23 can have rigid sides or can be formed of a flexible material, such as a fabric. Ordinarily, the case 23 will have some form of frame structure such that it will retain its basic shape regardless whether it is packed or unpacked. The case 23 will typically have a generally rectangular or square shape when viewed from any side. The case 23 will typically have a generally flat top surface 33 that can serve as a support surface for supplies during hairstyling. To conveniently serve as a support surface during hairstyling, the top surface 33 will typically be located at a convenient height for use by a standing person of average height, e.g., approximately 30" (approx. 76 cm), which may be accomplished by, for example, a conventional suitcase having a dimension of approximately 30" (approx. 76 cm). The interior of the case (FIG. 2) will ordinarily be provided with one or more dividers 35 that can function as shelves for holding supplies and equipment. Pockets and other holding structures (not shown) such as are found in conventional suitcases can also be provided. The case 23 can open in any suitable fashion, such as a "clamshell" type of case or a zippered flap 36 as seen in FIGS. 1 and 2.

The vacuum cleaner 25 will ordinarily be a conventional canister-type vacuum cleaner having a canister 27 that is sized to fit inside of the case 23, usually at the bottom of the case. By positioning the canister 27 at the bottom of the case 23, the center of gravity of the case will be kept low, particularly when the case is unpacked, and the case will have less of a tendency to tip than if the canister—which will ordinarily comprise a substantial portion of the total mass of the station—is disposed at some higher location. The canister 27 will ordinarily be disposed inside of the case 23, however, if desired, the canister can be attached outside of the case, such as in a recess in a hard-shell case, or at the bottom or along the side of a hard or soft case. By placing the canister 27 inside of the case 23, the case can muffle the noise of the vacuum cleaner 25. While it is ordinarily not necessary to run the vacuum cleaner 25 for more than a few minutes during a normal hairstyling operation, so the risk of overheating of the vacuum cleaner is ordinarily low, the case 23 can be provided with vents 37 to facilitate cooling of the vacuum cleaner.

Figure 3:
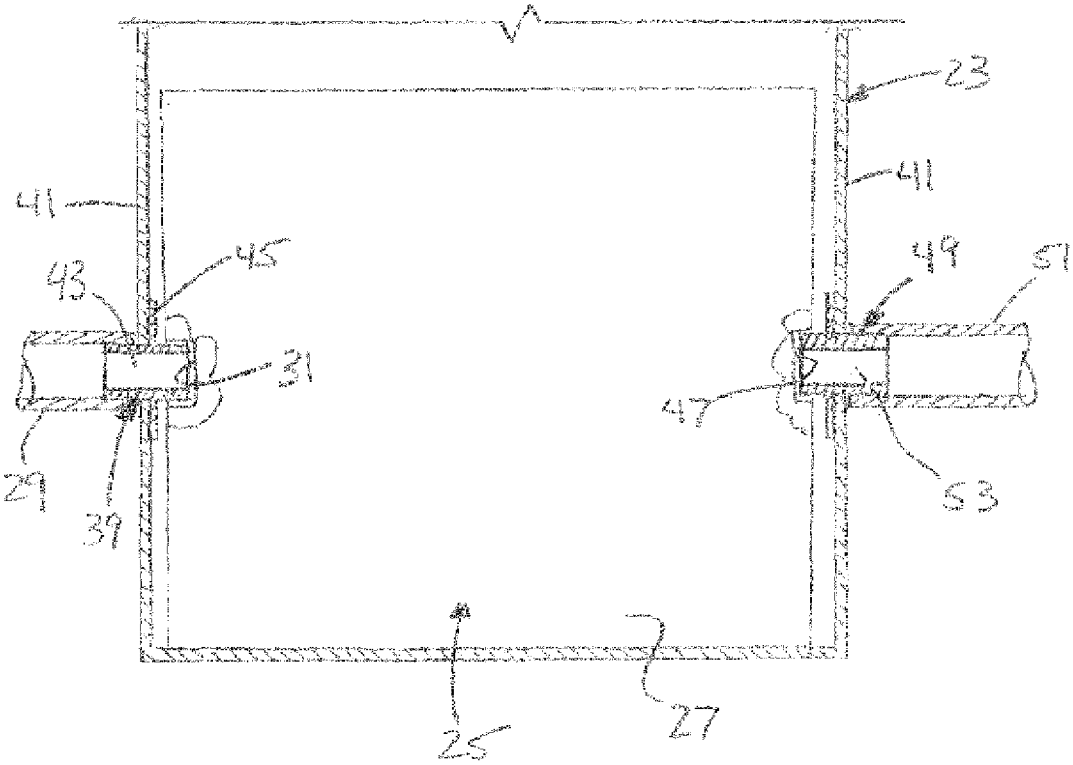
FIG. 3 is a partially cross-sectional schematic view of a portion of a portable hairstylists' station according to an embodiment of the present invention.

For convenience, an embodiment of the station 21 wherein the canister 27 of the vacuum cleaner 25 is disposed inside of the case 23 as illustrated in FIGS. 1 and 2 will be described, except where otherwise noted. As seen in FIG. 3, a suction fitting 39 for connecting the hose 29 to the suction opening 31 of the canister 27 can be provided. The suction fitting 39 can be mounted to a wall 41 of the case 23 and can include a suction passage 43 extending through the suction fitting between the hose 29 and the suction opening 31 of the canister 27. The suction fitting 39 can include a flange 45 that can be secured in place relative to the wall 41 of the case 23 by any suitable means, such as by an adhesive or rivets to secure the flange directly to the wall, or by providing the suction fitting with inner and outer portions (not shown) that secure to one another, such as by a snap or friction fit, around a hole provided in the case. The vacuum cleaner 25 will typically be of sufficient size and have sufficient suction strength to pick up hair and other waste resulting from a hairstyling operation.

The canister 27 of the vacuum cleaner typically also includes an exhaust opening 47. The exhaust opening 47 will ordinarily be disposed inside of the case 23 but can extend outside of the case (not shown). When the exhaust opening 47 is disposed inside of the case 23, an exhaust fitting 49 can be provided, although the vacuum cleaner 25 can exhaust inside of the case if desired. Ordinarily the exhaust fitting 49 will permit connection of an exhaust hose 51 to the exhaust opening 47, however, the exhaust fitting 49 may be provided to simply exhaust air from the canister 27 without any hose. Like the suction fitting 39, the exhaust fitting 49 can mounted in place relative to a hole in the wall 41 of the case 23 and can include an exhaust passage 53 extending through the exhaust fitting between the exterior of the case or the hose 51 and the exhaust opening 47 of the canister 27. By connecting the hose 51 to the vacuum cleaner 25 exhaust opening 47, the hose can be used to, e.g., blow hair off of a customer or to direct exhaust from the vacuum cleaner away from the site of the hairstyling operation to prevent scattering of hair and other materials.

As seen in FIG. 2, the station 21 will ordinarily include a chair 55 that is adapted to be at least partially disposed in the case 23. The chair 55 will ordinarily be of a type that is at least partially collapsible to permit the chair to be received partially or entirely inside of the case 23. The chair 55 may, for example, include a leg portion 57 that is separable from a seat portion 59. A useful form of leg portion 57 is of the type typically used in so-called "drummer's thrones" because it is foldable to a compact size for convenient carrying inside of the case 23. Also, many such drummer's throne-style leg portions are pneumatically adjustable, which is a highly desirable feature in a chair used for hairstyling of customers of various heights. The seat portion 59 will typically be attachable to the leg portion 57 and will include a back 61 that is foldable relative to a bottom portion 63. A lightweight foldable seat portion of a boating-type chair that has been adapted to be attachable to the leg portion 57 has proven to be useful for use as the seat portion 59. It is desirable to provide a back 61 on a seat used for hairstyling for comfort of the customer and for providing a professional appearance. The seat portion 59 can be folded for carrying inside of the case 23 or, as seen in FIG. 1, can be attached to the outside of the case, such as by providing an opening 65 in the back 61 of the seat through which a handle 67 of the case can extend. The bottom portion 63 of the seat portion 59 can hang over the side of the case 23. Straps 69 can be provided for securing the bottom portion 63 of the seat portion 59 to the case 23.

The case 23 will ordinarily include wheels 71, such as are typically provided on modern suitcases. The case 23 can also include a stand member 73 attached to the case. The stand member 73 can be extendable from and retractable into the case 23. For example, a retractable handle 67 of the case can form the stand member 73. As seen in FIG. 2, a structure such as a mirror 75 can be attachable to and detachable from the stand member 73, such as by VELCRO or other hook and pile-type fasteners, or by some other suitable fasteners. The station 21 will ordinarily also include at least one free-standing stand 77, such as a foldable and telescoping tripod-type or easel-type stand, adapted to be disposed in the case 23. The free-standing stand 77 can be used to hold structures such as a mirror 79 so that the mirror on the free-standing stand and a mirror 75 on the stand member 73 provide front and rear mirrors to facilitate permitting customers to inspect their hair from different angles.

The station 21 will ordinarily also include a power strip 81 adapted to be disposed inside of the case 23. The power strip 81 can comprise a power cord 83 having a male connector and plurality of female electrical sockets on the strip for attaching other male power cord connectors associated with, e.g., the vacuum 25 and at least one other electrically powered device such as a hair dryer 85, an electric razor 87, or a lamp 89 such as a lamp of the type adapted to be clipped to another structure, such as one of the mirrors 75 or 79 or stands 73 or 77, or an electronic sanitizer 90, such as the Salontech Mini Sanitizer, made by Salontech, Flushing, N.Y. The other electrically powered device(s) will ordinarily be adapted to be carried in the case 23. The case 23 will ordinarily be of sufficient size to carry several extension cords, and the electrically powered devices will ordinarily have cords of sufficient length to permit the hairstylist to move around the customer and the station 21 while holding the devices. A sheet 91 or tarp can be folded up in the case 23 and spread out beneath the chair 55 before each hairstyling operation to catch hair and other waste. In addition to the electrical sanitizer 90, conventional liquid sanitizers may also be provided in suitable containers (not shown) in the case 23.

The present invention facilitates conducting a hairstyling business in a new way, particularly in that it facilitates allowing hairstylists to work independently and at a schedule of their choosing, without a substantial portion of their fees having to go toward paying the overhead for a conventional "brick-and-mortar" hairstyling salon. A customer can schedule a hairstyling appointment at a location of the customer's choosing. The hairstylist may, of course, be at another location at the time of scheduling, although he or she need not be. The hairstylist can transport himself or herself and the portable hairstylists' station 21 to the customer location at the scheduled time and perform a hairstyling operation at the customer location using the portable hairstylists' station.

The present invention can facilitate providing a work environment having substantially all of the articles found in conventional hairstyling salons. Also, by providing features such as a vacuum cleaner 25, a sheet 91, and an electrical sanitizer 90, appropriate sanitation can be provided, facilitating licensing of operators.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A portable hair stylists' station having a use mode in which the station defines a hair salon and a transport mode in which the station is transportable as a single unit, comprising:

a wheeled carrying case comprising an extendable and retractable handle at a top end of the case, the case having an interior, and means for opening and closing the case;

a chair comprising a leg portion and a seat portion, the leg portion being removably attachable to the seat portion and being adapted to be folded and received in the interior of the case, the seat portion comprising a back portion and a bottom portion, the seat portion comprising an opening and, when the station is in a transport mode, the handle extends through the opening to attach the seat portion to the case; and a vacuum cleaner comprising a canister in the interior of the case and a hose adapted to be connected to a suction opening of the canister.

2. The portable hair stylists' station as set forth in claim 1, comprising a suction fitting for connecting the hose to the suction opening of the canister, the suction fitting being mounted to a wall of the case and including a suction passage extending through the suction fitting between the hose and the suction opening of the canister.

3. The portable hair stylists' station as set forth in claim 2, comprising an exhaust fitting for connecting the exhaust opening of the canister to the outside of the case, the exhaust fitting being mounted to a wall of the case and including an exhaust passage extending through the exhaust fitting between the outside of the case and the exhaust opening of the canister.

4. The portable hair stylists' station as set forth in claim 3, comprising an exhaust hose attachable to the exhaust fitting.

5. The portable hair stylists' station as set forth in claim 1, wherein the canister includes an exhaust opening, the exhaust opening being disposed inside of the case.

6. The portable hair stylists' station as set forth in claim 1, wherein the leg portion of the chair is pneumatically adjustable to different heights.

7. The portable hair stylists' station as set forth in claim 1, comprising a free-standing stand adapted to be disposed in the case.

8. The portable hair stylists' station as set forth in claim 1, comprising at least one compartment for hair styling supplies.

9. The portable hair stylists' station as set forth in claim 1, wherein the case comprises a substantially flat top surface portion.

10. The portable hair stylists' station as set forth in claim 1, comprising a power strip adapted to be disposed inside of the case, the power strip comprising a power cord having a male connector and plurality of female electrical sockets for attaching male power cord connectors associated with the vacuum and at least one other electrically powered device.

11. The portable hair stylist's station as set forth in claim 1, comprising a plurality of dividers disposed in the interior of the case, the dividers defining a plurality of compartments.

12. The portable hair stylist's station as set forth in claim 11, wherein at least some of the dividers define horizontal surfaces when the station is in the use mode.

13. The portable hair stylist's station as set forth in claim 1, wherein the vacuum cleaner is disposed at a bottom end of the case and comprises a horizontally oriented canister.

14. The portable hair stylist's station as set forth in claim 13, wherein a portion of the seat portion hangs over a side of the case and a portion of the seat portion is disposed over the top end of the case when the station is in the transport mode and the seat portion is attached to the case.

15. The portable hair stylist's station as set forth in claim 14, comprising straps for securing the portion of the seat portion that hangs over the side of the case to the case.

16. The portable hair stylist's station as set forth in claim 14, comprising a mirror, the mirror being adapted to be disposed in the interior of the case when the station is in the transport mode and the mirror comprising attachment means for removably securing the mirror to the handle when the station is in the use mode.

17. The portable hair stylist's station as set forth in claim 1, wherein a portion of the seat portion hangs over a side of the case and a portion of the seat portion is disposed over the top end of the case when the station is in the transport mode and the seat portion is attached to the case.

18. The portable hair stylist's station as set forth in claim 17, comprising straps for securing the portion of the seat portion that hangs over the side of the case to the case.

19. The portable hair stylist's station as set forth in claim 17, comprising a mirror, the mirror being adapted to be disposed in the interior of the case when the station is in the transport mode and the mirror comprising attachment means for removably securing the mirror to the handle when the station is in the use mode.

20. The portable hairstylist's station as set forth in claim 1, comprising a mirror, the mirror being adapted to be disposed in the interior of the case when the station is in the transport mode and the mirror comprising attachment means for removably securing the mirror to the handle when the station is in the use mode.

21. The portable hair stylist's station as set forth in claim 1, wherein the case has dimensions such that a length of the case plus a width of the case plus a height of the case is no more than approximately 62" (approximately 157 cm).

22. The portable hair stylist's station as set forth in claim 21, wherein the station has a total weight of no more than approximately 50 lbs (approximately 23 kg).

* * * * *